US006668730B2

(12) United States Patent
Goldbeck

(10) Patent No.: US 6,668,730 B2
(45) Date of Patent: Dec. 30, 2003

(54) INDEXER CARRIAGE CHAIN TENSION AND DOG CONTROL SYSTEM

(75) Inventor: Bradley J. Goldbeck, Montrose, MN (US)

(73) Assignee: Calbrandt, Inc., Delano, MN (US)

( * ) Notice: Subject to any disclaimer, the term of this patent is extended or adjusted under 35 U.S.C. 154(b) by 0 days.

(21) Appl. No.: 10/053,834

(22) Filed: Jan. 22, 2002

(65) Prior Publication Data

US 2003/0136295 A1 Jul. 24, 2003

(51) Int. Cl.[7] ..... B61J 3/04

(52) U.S. Cl. ..... 104/162; 104/172.3; 198/746; 414/359

(58) Field of Search ..... 104/162, 176, 104/166, 172.5, 172.3, 165; 198/746, 743, 744, 736, 738; 414/359, 131

(56) References Cited

U.S. PATENT DOCUMENTS 3,854,537 A * 12/1974 Nelmark et al. ..... 173/140
4,354,792 A * 10/1982 Cornish ..... 414/359
4,588,073 A * 5/1986 Abell ..... 198/781.06
5,287,812 A 2/1994 Lobb et al.
5,709,153 A * 1/1998 Brandt ..... 104/162
5,806,745 A * 9/1998 Irwin ..... 226/74
6,267,059 B1 7/2001 Brandt
6,389,984 B2 * 5/2002 Brandt ..... 104/162

* cited by examiner

*Primary Examiner*—S. Joseph Morano
*Assistant Examiner*—Frantz F. Jules
(74) *Attorney, Agent, or Firm*—Nikolai & Mersereau, P.A.; C. G. Merereau

(57) ABSTRACT

A reversing chain-operated, dual carriage train indexer is provided with a chain tension control that acts directly on the chain and a retraction-biased, two-position carriage connection cylinder in conjunction with a spring biased linkage system allows indexer operation in either direction with dogs up or down in dual force ranges controlled by the chain tension control.

15 Claims, 9 Drawing Sheets

| TRUTH TABLE | 00007 | 00008 | 00009 | 00010 | 00011 | 00012 |
|---|---|---|---|---|---|---|
| MOVE CARRAIGE WITH DOGS DOWN | | | EAST | WEST | ⬭ | |
| MOVE CARRAIGE WITH DOGS UP | | ⬭ | EAST | WEST | ⬭ | ⬭ |
| STOP CARRAIGE WITH DOGS UP | | ⬭ | EAST | WEST | | ⬭ |
| STOP CARRAIGE WITH DOGS DOWN | | | | | | |

KEY: ⬭ = ENERGIZED SOLENOID

EAST = ENERGIZE SOLENOID WHEN MOVING EAST OR TO KEEP DOGS RAISED AFTER MOVING EAST

WEST = ENERGIZE SOLENOID WHEN MOVING WEST OR TO KEEP DOGS RAISED AFTER MOVING WEST

*NOTE: EAST AND WEST SOLENOIDS CAN NEVER BE ENERGIZED AT THE SAME TIME

FIG. 8B

INDEXER CARRIAGE CHAIN TENSION AND DOG CONTROL SYSTEM

BACKGROUND OF THE INVENTION

I. Field of the Invention

The present invention relates generally to railway car handling or train positioning equipment and, more particularly, to an apparatus for indexing a string of cars through a work station wherein the cars remain coupled. Within this field, the invention further focuses on a drive system for such an indexer which includes automated direct chain tension control which not only enables the chain to be maintained snug in all sprockets and dog carriages to be moved freely with the dogs retracted in a seeking mode in either direction at one force level, but also enables and controls deployment of the dogs and operation of the carriages to move cars in either direction under full load in a second force range.

II. Related Art

Trains of varying lengths, some containing as many a hundred or more cars of various sizes and shapes, have long been acknowledged as desirable and efficient carriers of bulk raw material such as coal, iron ore, limestone, various finely divided dry bulk agricultural produces including grains, etc., and liquid or dry chemicals. These cars are typically filled from above and, while some may be emptied using a rotary car dumper as in the case of coal or iron ore, most and particularly, those carrying agricultural products, are bottom-emptied over stationary freight handling equipment such as chutes, conveyor handlers or the like. Thus, whether being loaded or unloaded, the cars may have to be precisely positioned under or over dedicated filling or receiving facilities situated at fixed stations along the railroad track.

In the discharge operation, a connected train engine roughly positions one end of a string of cars to be unloaded close to the unloading facility. Because train engines are not well suited for indexing or precisely positioning individual cars or even strings of cars along the track, let alone precisely over individual bins, train positioning devices known as railroad car progressors or indexers have been built and operated at fixed stations. Railroad car indexers of the class of interest include at least one car engaging and propelling member or "dog" for engaging at least one railroad car in a string or trip of cars and moving the string a given distance along the railroad track. The car engaging members are most often situated and operated along an auxiliary indexer track or guideway juxtaposed in parallel relation to the railroad track in the fixed receiving facility. Many car indexers of the class are operated utilizing chains and sprockets to move carriages carrying train-engaging dogs which may operate against the railroad car bogey frames. Indexers of the class are shown, for example, in U.S. Pat. Nos. 4,354,792, 5,709,153 and 6,267,059. As can be seen from these examples, the dogs may be operated vertically or horizontally to engage the bogey frames or even couplings of the cars of interest.

One long standing problem involved with chain-operated railway car indexer systems involves the inability to maintain continuous proper chain tension. Thus, an initially tight chain, after numerous operations of the indexer system, loosens as parts tend to wear and the chains then become loosely engaged in the sprockets to the point where teeth may be skipped and malfunctions occur. In the past, these problems were addressed by periodically taking the system out of service to remove one or more links from the chain to restore continuity between the chain and all sprockets involved. It would clearly present an advantage in such a system were the chain tension subject to continuous and automated control. It would create an even still further advantage if an automated chain tensioning system could be realized, not only to maintain proper tension in the system in a first or lower force range when the system is utilized to find and engage a railway car, but also in a second or higher force range to deploy dogs to engage and move the cars to the desired position.

SUMMARY OF THE INVENTION

The present invention enables a desired tension to be maintained directly from the chain of a chain-operated single direction or reversing railway car indexing system by the provision of a tension regulating system which includes a position-adjustable idler sprocket in conjunction with a controlled operating device with capabilities of producing a plurality of force ranges in the chain which encompass both a dog-retracted idling or car-seeking mode and a dog-deploying car-engaging and positioning mode.

In one embodiment, this system is utilized in conjunction with a two-position carriage-connecting cylinder in a dual-carriage reversing car indexing system in which opposed pivotally-mounted dogs are connected by a fixed length tension linkage through a self-centering spring cylinder in a manner such that extension of the carriage-connecting cylinder produces a corresponding movement in the linkage connections which, in turn, produces pivotal deployment of the opposed dogs. In another embodiment using horizontally pivoting dogs, the linkage between dogs may consist of a single connecting rod.

The pair of consecutive oppositely disposed dog carriages, each carrying an operable car-engaging dog together form a pair of opposite facing or opposed spaced dogs for use in a reversing system, the inward facing carriage ends being connected by the extensible carriage connecting cylinder which is biased to remain in a retracted or collapsed position until the biasing force is overcome. Biasing is preferably accomplished by utilizing a supply of gas-pressurized fluid to maintain the desired force on the cylinder rod end.

The system typically operates in a seeking or idling mode with a chain tension force between 3,000 lbs. (1360.5 kg) and 6,000 lbs (2721 kg) which is sufficient to operate the indexer along the indexing guideway while seeking a railway car with dogs retracted or down and the inter-carriage distance at a minimum. When it is desired to deploy the dogs in moving or in engaging a bogey frame, or the like, the chain force can be increased above the 6000 lbs (2721 kg) threshold necessary to extend the carriage connecting cylinder to its full length at which point it becomes a connecting rod and, at the same time, causes the linkage between the dogs to raise or deploy the dogs.

The spring cylinder used in some embodiments contains internal springs which bias the dogs in a down or retracted position. The self-centering spring cylinder compression springs, however, further compress as required to allow a dog to be downed or pushed back as by contact with an obstruction bogey frame from behind in one direction while allowing the other dog to remain in its extended or raised position. Conversely, the compression springs also compensate transition for the situation in which the system pressure is reduced so that the dogs try to retract, but a dog is held in the raised or deployed position by an external force as by being at the time up against a bogey frame by allowing the unobstructed dog to retract or drop even though the other dog is prevented from retracting until the bogey frame is cleared.

BRIEF DESCRIPTION OF THE DRAWINGS

In the drawings, wherein like numerals depict like parts throughout the same:

FIG. 8*b* is a truth table associated with the schematic diagram of FIG. 8*a*.

DETAILED DESCRIPTION

It should be kept in mind that one aspect of the present invention enables a desired minimum tension to be maintained in the chain of a chain-operated single direction or reversing railway car indexing system by the provision of a tension regulating system that includes a position-adjustable idler sprocket operable against the chain to create a desired tension. This aspect is particularly suited to systems which systems that over time develop slack in the drive chains which require adjustment by link removal or the like.

The system also enables the operation of a variety of indexers which require multiple chain tension ranges during the course of their operation. The reversing indexers that are the subject of the detailed embodiments are presented by way of example only and not limitation. The detailed embodiments involve dual carriage reversing indexer units which include a force-biased two-position inter-carriage linkage and an associated inter-connected force-biased dog operating linkage mechanism. The multiple chain tension ranges enable the indexer to operate in a seeking mode in the first chain tension range in which the dogs are retracted or down and carriages a minimal distance apart while seeking a railcar to move. Thereafter, a high tension range may be used to deploy the dogs and move engaged cars. The use of a sufficiently high minimum tension or first range also enables the entire drive system to maintain proper sprocket engagement for the chain in all phases of operation.

Figure 1:
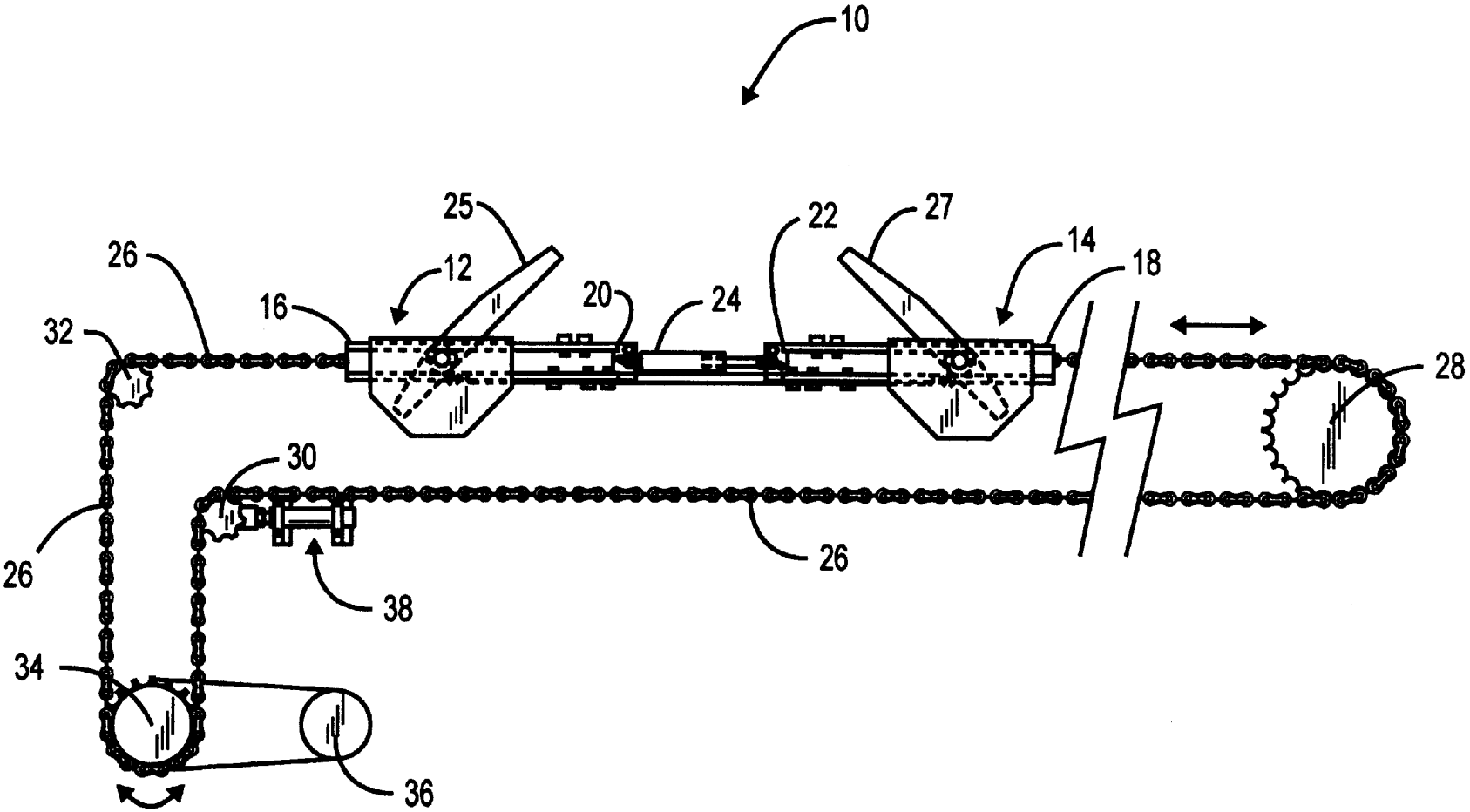
FIG. 1 depicts a broken schematic plan or layout view of one possible embodiment of a railway car indexer in accordance with the present invention.

FIG. 1 depicts a broken schematic plan view or layout of a possible chain driven reversing indexer using the tension control system of the present invention. The system, generally at 10, includes a pair of oppositely disposed dog carriages 12, 14, respectively, having outward facing or far ends 16, 18 and respective near or inward directed ends 20 and 22 connected by a connector cylinder 24 (shown in greater detail in FIGS. 3–5*c*).

Each dog carriage 12, 14 carries a horizontally pivoting low-clearance dog member as at 25 and 27, shown partially deployed in the figure. The carriage and dogs of FIG. 1 represent a type of low clearance train positioner system described in greater detail in U.S. Pat. No. 6,267,059, the details of which are hereby incorporated by reference for any purpose.

The far or outward facing ends 16 and 18 of the respective carriages 12 and 14 are connected to opposite ends of a continuous drive chain 26, shown broken in FIG. 1. The drive chain 26 is also carried by a main tail idler sprocket 28, idler sprocket 32, tension adjusting idler sprocket 30 and a drive sprocket 34 which, in turn, is concentrically connected to a reversible prime mover 36, which may be a hydraulic motor or any other suitable device. The drive sprocket 34 may be mounted on the output shaft of a planetary gear box or other speed reducer if desired.

Figure 2:
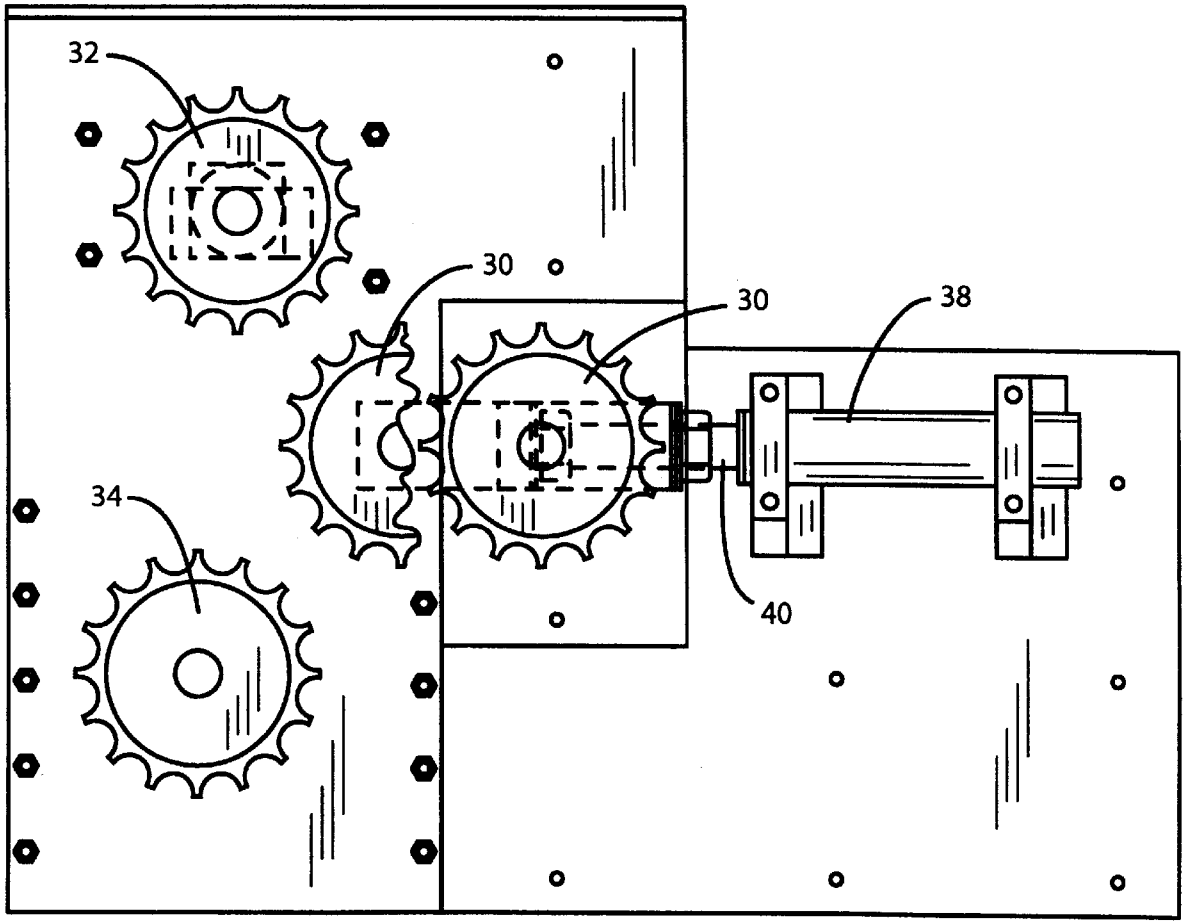
FIG. 2 is an enlarged schematic drawing partially in phantom depicting a chain tension controlling system in accordance with the invention (shown without the chain)

As is best pictured in the enlarged detail view of FIG. 2, the mounting of idler sprocket 30 is horizontally displaceable (an inward displaced position being pictured in phantom in FIG. 2) relative to sprockets 34 and 32 to adjust chain tension. The adjustment is accomplished by using a linear operator of adjustable force such as a hydraulic cylinder 38 with extendible rod 40. One such system uses a cylinder with a 4" (10.76 cm.) bore and 3" (7.62 cm.) diameter rod and having a 12" (30.48 cm.) effective stroke. This provides sufficient stroke to allow tension in the chain to be adjusted with the connecting cylinder either fully extended or fully retracted. A typical stroke of the connecting cylinder between full retraction and full extension in an embodiment such as that pictured in FIGS. 4*a*–4*c* is approximately 5" (12.7 cm.) and in the embodiment shown in FIGS. 5*a*–5*c*, the total stroke is approximately 9" (22.86 cm.).

Figure 3:
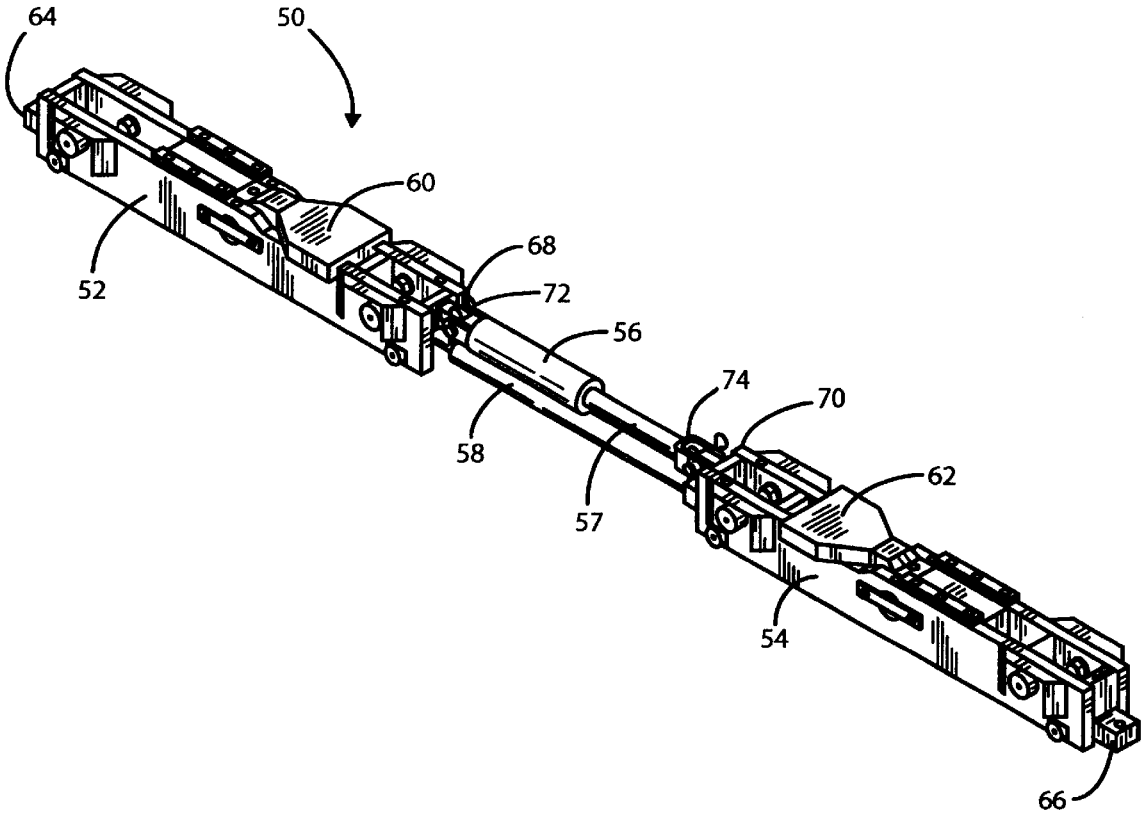
FIG. 3 is a perspective view of a pair of consecutive oppositely disposed dog carriages connected in accordance with one aspect of the present invention.

FIG. 3 depicts a similar connected dual opposed carriage indexer embodiment 50 with carriages 52 and 54, connecting cylinder 56 and a dog-operating spring cylinder 58 is mounted beneath connecting cylinder 56. Carriage 52 carries a vertically pivoting dog 60 and carriage 54, a dog 62, and outer end chain receiving members are shown at 64 and 66. The blind end of cylinder 56 and the end of rod 57 are fixed to the respective inward directed ends 68 and 70 of carriages 52 and 54 by conventional clevis and pin arrangements 72 and 74, as shown, it being noted that the carriage gap or separation span is determined by the state of extension of cylinder rod 57.

An important aspect of the invention further involves the connection between carriage separation and dog deployment as the operation of the dogs is also controlled by carriage separation. This can best be seen in the side elevational views of FIGS. 4*a*–4*c* which depict the low dog vertical embodiment of FIG. 3, the opposed dogs 60 and 62 are connected by a mechanical linkage which operates through the spring cylinder 58 and which includes compression springs 80 and 82 and movable linkage member 84 with piston 85 and linkage member 86 which is fixed relative to the cylinder 58. FIG. 4*a* depicts the cylinder 56 with rod 57 in a fully collapsed position and the mechanical dog linkage in the fully extended position forcing the dogs 60 and 62 to remain down. In FIG. 4*b,* the rod 57 is shown partially extended and the inter-dog linkage has correspondingly caused the dogs 60 and 62 to assume a partially raised or partially deployed position. FIG. 4*c* depicts the rod 57 of cylinder 56 in the fully extended position and the dogs fully raised.

Figure 4A:
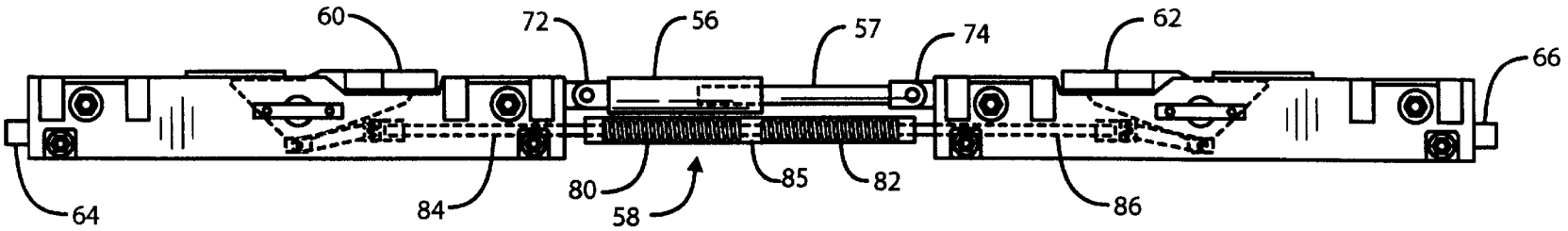
FIGS. 4*a*–4*c* are side views depicting three positions of a type of vertically pivoting dogs connected to operate in accordance with one aspect of the invention.
Figure 4B:
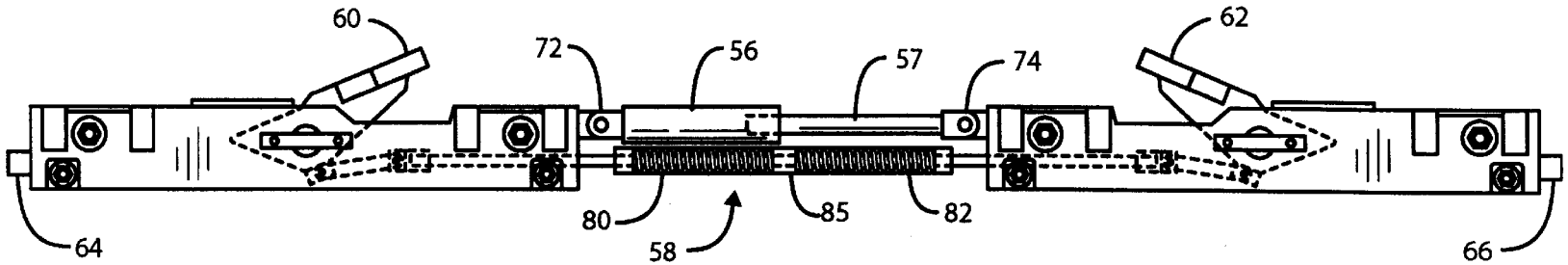
Figure 4C:
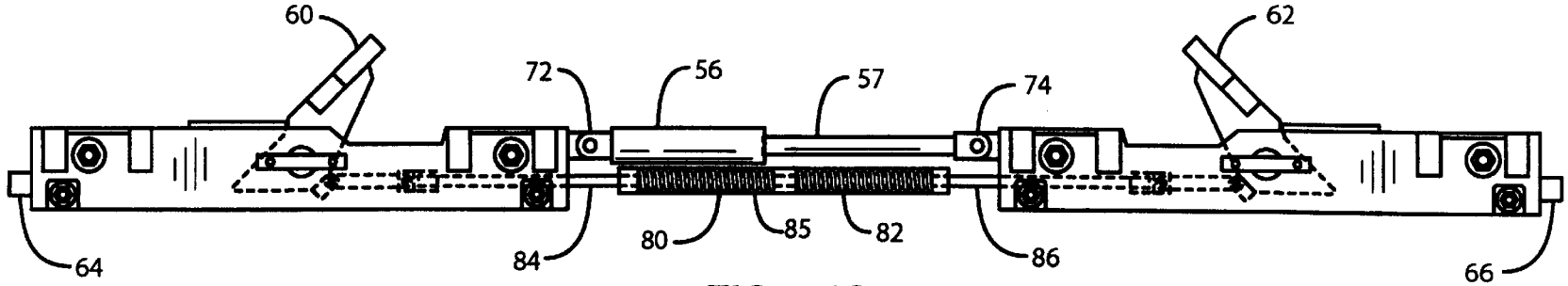

It will be noted that compression springs 80 and 82 enable the dogs 60 and 62 to be biased in a dropped or down position with the cylinder fully retracted as in FIG. 4*a,* but also compress to enable an individual dog 60, 62 to be depressed from the fully raised position as by running under a bogey frame without affecting the extended position of the other dog. Conversely, compression springs 80 and 82 also enable a dog to be held up, as by a bogey frame, when the connecting cylinder is in a fully retracted position and a free dog is dropped.

Figure 6A:
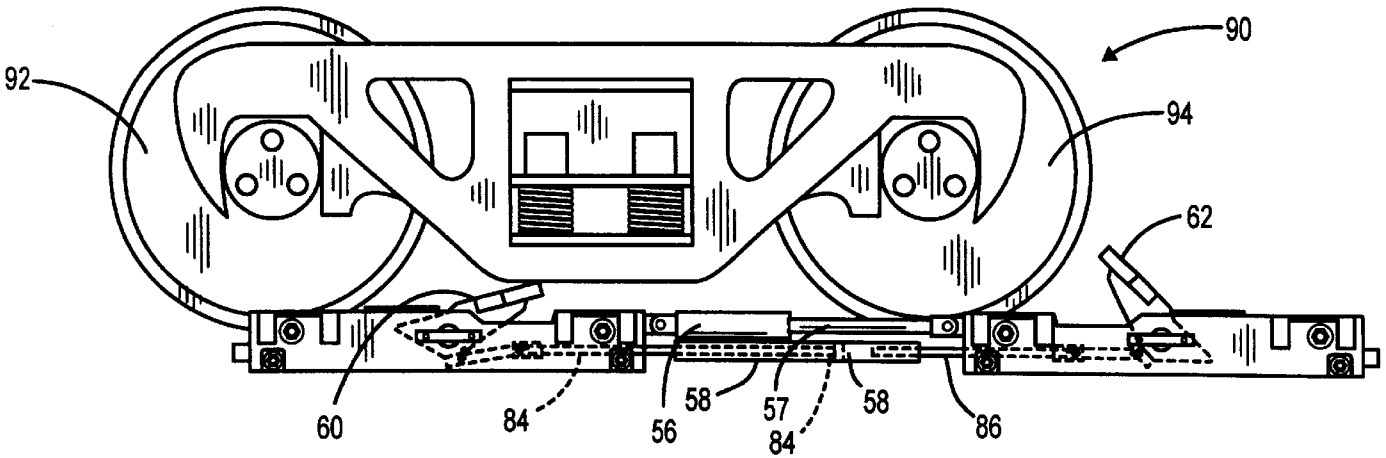
FIG. 6*a* is an enlarged view showing the operation of a spring cylinder linkage as in FIGS. 4*a*–4*c* with one dog held down by a bogey frame and the other, a free dog, deployed.
Figure 6B:
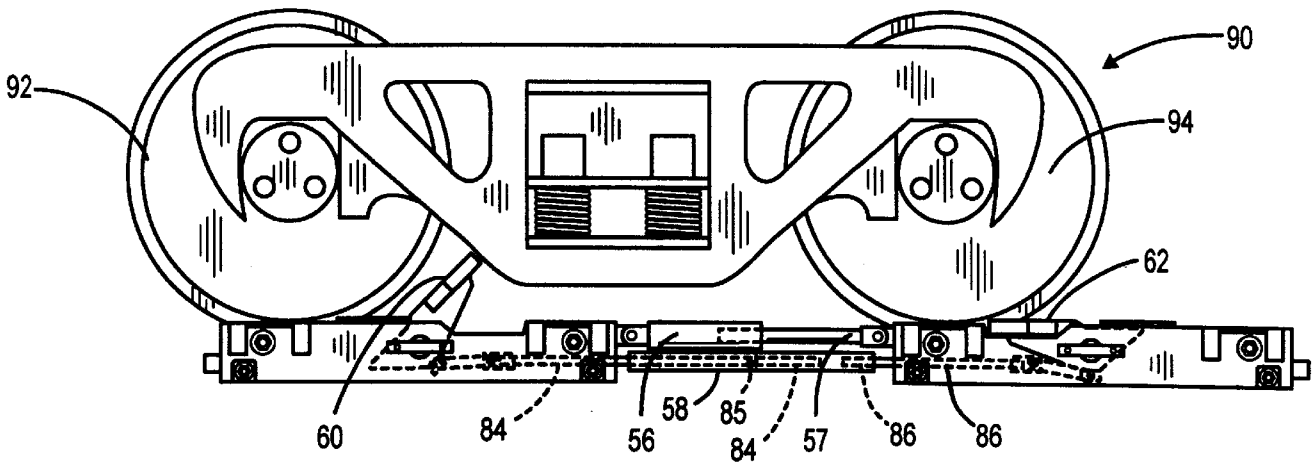
FIG. 6*b* is a view similar to FIG. 6*a* showing the operation of a spring cylinder linkage in the retracted (dogs down), one dog obstructed by a bogey frame.

These conditions are illustrated in the enlarged detailed views of FIGS. 6*a* and 6*b* in which the springs themselves have been removed for clarity to illustrate rod positioning. The figures depict the car carriage 90 with sets of wheels 92 and 94 and connected by bogey frame members as at 96. In FIG. 6*a,* the bogey frame member 96 is shown depressing the dog 60 thereby causing the connecting rod 84 to extend with piston 85 compressing spring 80 (not shown). The free dog 62 remains in the fully upright position. Of course, were the rolls reversed, dog 62 likewise could be depressed under the bogey frame member 96 with dog 60 fully extended as the free dog. In FIG. 6*b,* the connecting cylinder 56 and rod 57 are pictured in the fully retracted position, normally associated with downing of the dogs 60 and 62. However, the dog 60 this time is caught in the upright position against bogey frame member 96 and is able to remain in that position while the free dog 62 drops. After the carriage 90 moves a sufficient distance to the right so that the dog 60 clears the bogey frame member 96, the dog 60 likewise will drop. These figures illustrate the flexibility of the dog-operating linkage utilizing the spring cylinder.

Figure 7A:
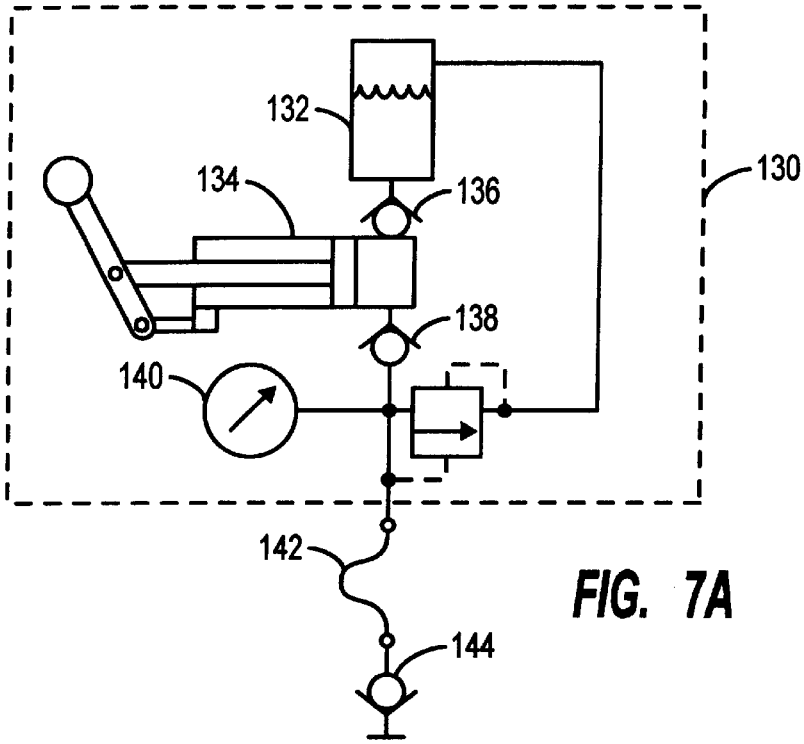
FIG. 7*a* schematically represents a portable hydraulic hand pump for charging oil into the inter-carriage connecting cylinder.
Figure 7B:
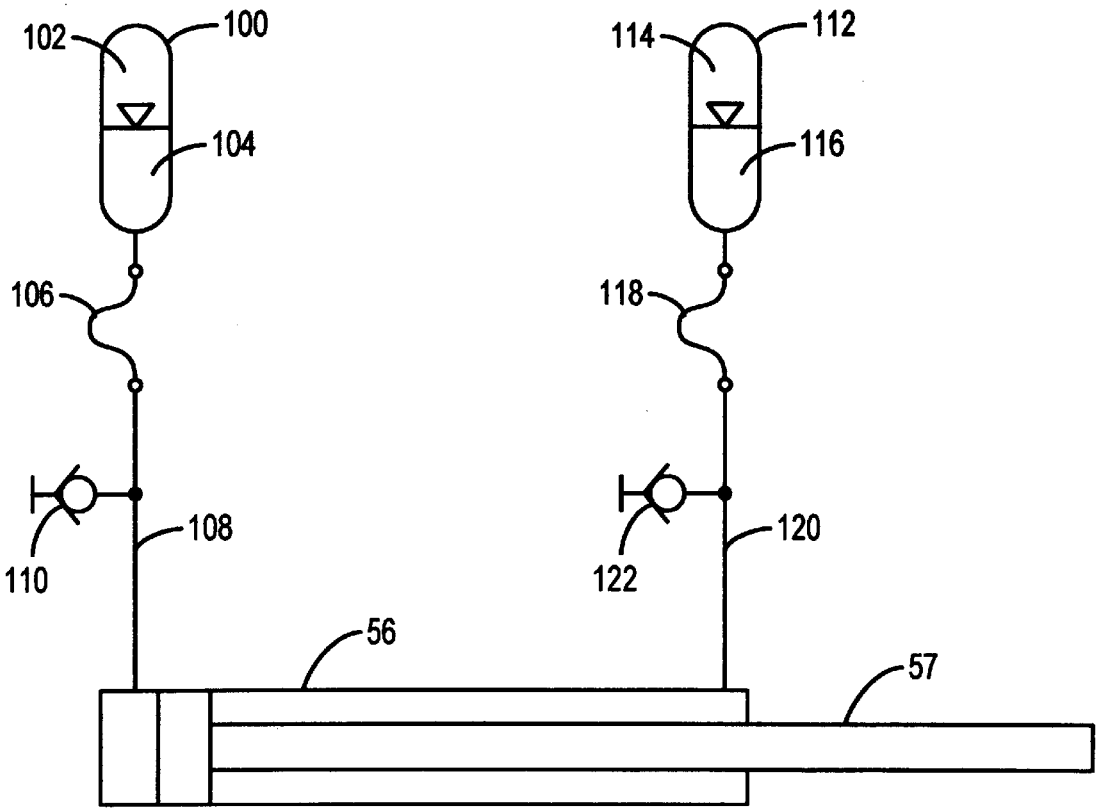
FIG. 7*b* is a schematic diagram of a connector cylinder with attached biasing components.

FIGS. 7*a* and 7*b* further illustrate one embodiment of connecting cylinder 56 with rod 57 in schematic form. The system as shown in 7*b* includes a blind end low pressure system and a rod end high pressure system. The blind end low pressure system includes an accumulator 100 having an inert gas precharge 102 over a hydraulic fluid cylinder oil charge at 104 connected by a hose 106 to a hookup at 108 which include an oil input check valve 110. Likewise, the cylinder end includes a high pressure accumulator 112 which includes an inert gas precharge at 114 and an oil reservoir 116 connected by hose 118 to input inlet 120 and includes input check valve 122. The gaseous precharges 102 and 114 are typically nitrogen precharges to a desired accumulator pressure. As needed, additional oil may be supplied to the blind end at 110 and the rod end at 122 utilizing a mechanism such as a portable hydraulic hand pump such as is illustrated in the block 130 of FIG. 7*a* and which includes a fluid reservoir 132, a hand-operated pumping mechanism 134 valved at 136 and 138, a pressure gauge 140 and a connecting hose 142 suitably valved at 144. This system can be attached to the cylinder inputs 110 and 122 to charge the blind end and rod end of the cylinder with oil respectively as needed.

Figure 8A:
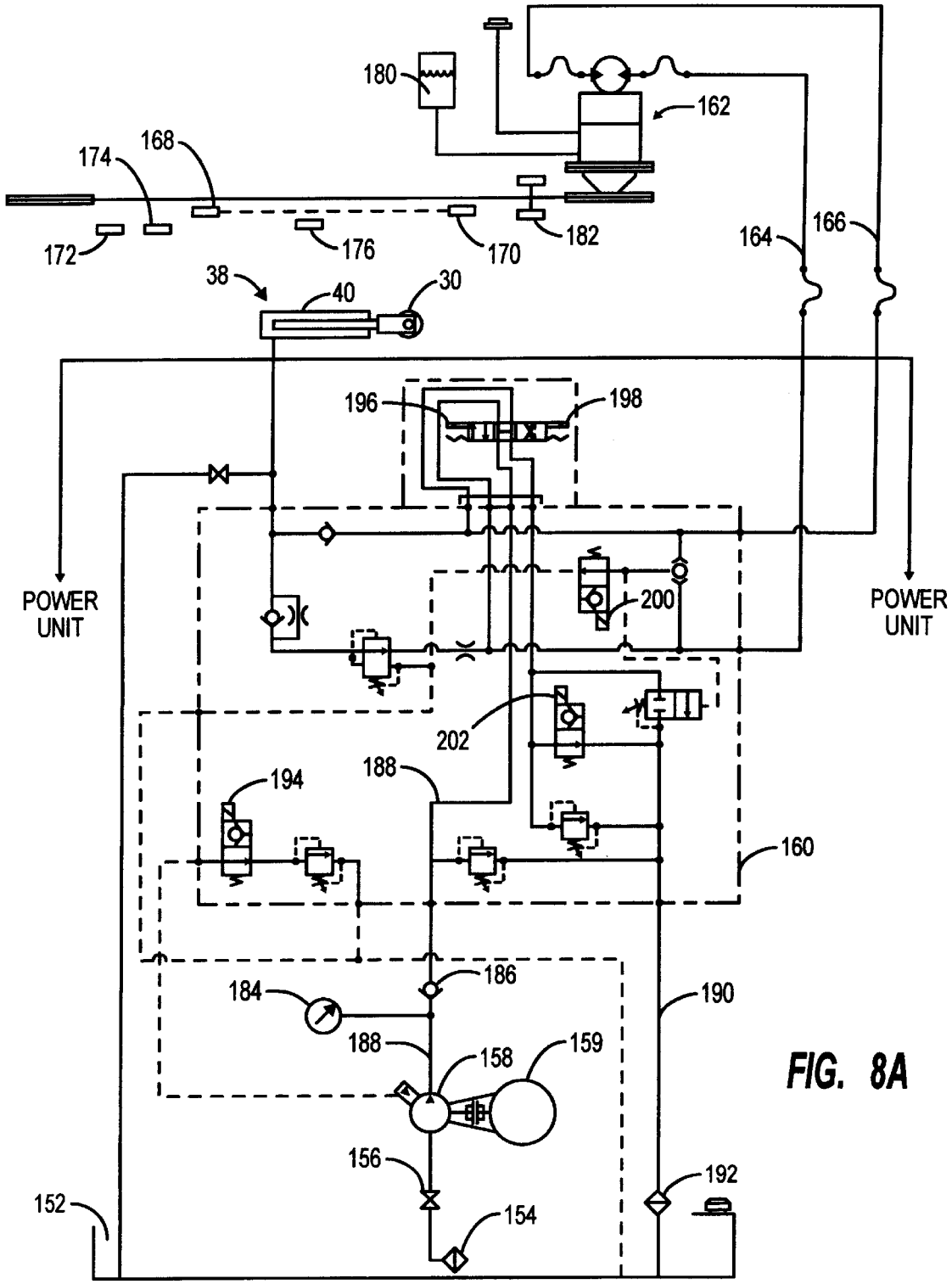
FIG. 8*a* is a partial hydraulic schematic for one embodiment of the invention.

FIG. 8*a* depicts a hydraulic control schematic for the embodiment of FIGS. 3 and 4*a*–4*c* and the associated truth table as shown in FIG. 8*b*. The schematic pictures a hydraulic reservoir at 152 which is connected through a strainer 154 and valve 156 to a suitable hydraulic pump 158 with drive motor 159. The output pressure of which is controlled by the system as shown in the broken line at 160. The hydraulic tension cylinder 38 with rod 40 and tension sprocket 30 are also depicted. The carriage drive system is shown generally at 162 connected to the system by hydraulic lines 164 and 166. A bogey frame location system includes a locator emitter 168 and receiver 170. Proximity switches are shown at 172, 174 and 176. The operation of these systems, while of interest is well known to those skilled in the art, and since they form no part of the present invention, it is believed, need not be described in greater detail. The system further includes a grease reservoir 180, an optical chain counting system at 182 and a main pressure gauge 184 with check valve 186. The hydraulic supply line is shown by 188 and the return or drain line by 190 with return filter 192. The two-position chain tension system corresponds to the operation of the hydraulic supply pressure at two distinct valves. In the drawing of FIG. 8*a*, a supply pressure of 600 psi (42.18 kg/cm$^2$) at RV2 is used to operate the system with dogs down and a supply pressure of 1600 psi (112.48 kg/cm$^2$) at RV1 is used to operate the system with dogs up.

With respect to the truth table, for ease of identification, valve-operated 00008 is depicted by 194 and operators 00009 and 00010 by 196 and 198 respectively. Likewise, operator 00011 is depicted by 200 and 00012 by 202. The operation of these is coordinated with the truth table of FIG. 8*b* enabling the operation of the carriage in either direction with the dogs up or down as shown.

Figure 5A:
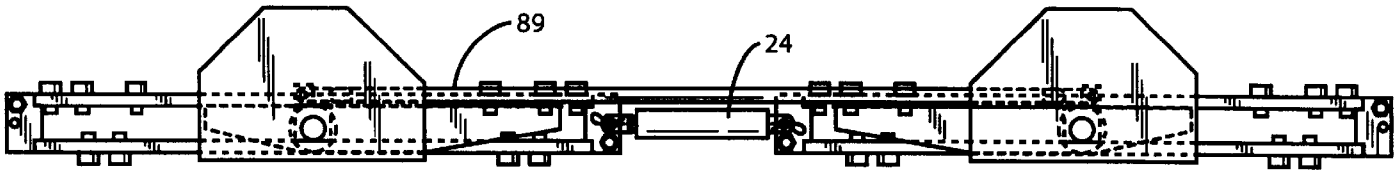
FIGS. 5*a*–5*c* depict an embodiment employing low clearance horizontally pivoting dogs similar to that of FIG. 1.
Figure 5B:
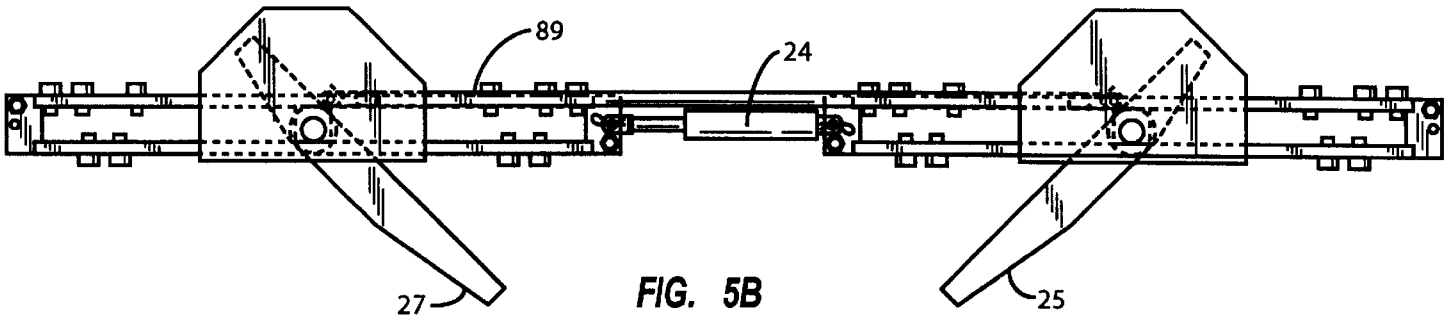
Figure 5C:
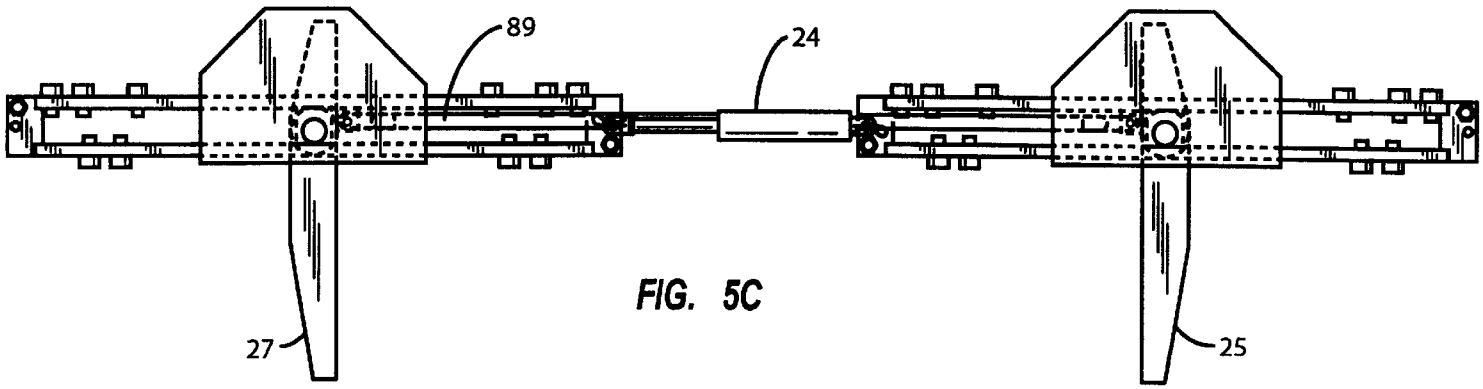

FIGS. 5*a*–5*c* depict top views of a system similar to that depicted in FIG. 1 with horizontally operating dogs 25 and 27, which is similar to the system of FIGS. 3 and 4*a*–4*c* employing connecting cylinder 24. However, this embodiment employs a single linkage member as at 89 to connect the dogs in fixed linkage. This is possible because this type system is normally operated only after the approximate bogey frame is separately detected and located so that the dogs can be deployed or retracted only when both dogs are free. Such a system is described in greater detail in the above cross-referenced U.S. Pat. No. 6,267,059 which is hereby incorporated by reference herein.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself. For example, the drive chain and sprocket system may be replaced by a system of cable and pulleys.

What is claimed is:

1. A reversing railway car indexer for engaging and moving one or more railway cars to a desired location comprising:

(a) a pair of consecutive, oppositely disposed dog carriages, each carrying an operable car-engaging dog and each having an inward facing and an outward facing end;

(b) an extensible connecting cylinder for connecting said inward facing ends and controlling a gap therebetween;

(c) a continuous drive chain connecting said outward facing ends;

(d) a mechanized drive chain tension control system for continuously controlling drive chain tension; and (e) a drive system for reversibly moving said drive chain.

2. An apparatus as in claim 1 wherein said connecting cylinder is biased to remain retracted until a desired minimum chain tension is exceeded to overcome said bias.

3. An apparatus as in claim 2 wherein the minimum chain tension is sufficient to allow reversible operation of the indexer along the track freely with said car-engaging dogs retracted.

4. An apparatus as in claim 2 wherein said drive chain tensioning control system includes a position adjustable idler sprocket and a pressure-sensitive operator for said position adjustable idler sprocket.

5. An apparatus as in claim 4 wherein said pressure sensitive operator for said drive chain tensioning control system includes a linear operator for moving said idler sprocket a sufficient distance and increasing the force on said chain such that said bias is overcome and said extensible cylinder is fully extended and said dog operating linkage causes said pair of dogs to be deployed.

6. An apparatus as in claim 2 including dog operating linkage for deploying and retracting said car-engaging dogs of said pair of consecutive dog carriages, connected between the dogs of said pair of consecutive dog carriages, wherein said dog operating linkage responds to the extension of said connecting cylinder increasing said gap between said pair of dog carriages by causing said dogs to pivot toward a deployed posture.

7. An apparatus as in claim 6 wherein said dog operating linkage further comprises a double-ended, self-centering spring cylinder.

8. An apparatus as in claim 6 wherein the minimum chain tension is sufficient to allow reversible operation of the indexer along the track freely with said car-engaging dogs retracted.

9. An apparatus as in claim 7 wherein said spring cylinder includes internal springs that cooperate with said dog operating linkage to allow one car-engaging dog to be retained in a deployed position by external forces while the other car-engaging dog of said dogs of said pair of consecutive dog carriages is retracted.

10. An apparatus as in claim 7 wherein said spring cylinder includes internal springs that cooperate with said dog operating linkage to allow one car-engaging dog to be forceably retracted by external forces while the other connected dog of said dogs of said pair of consecutive dog carriages remains in the deployed position.

11. An apparatus as in claim 1 wherein said drive chain tensioning control system includes a position adjustable idler sprocket and a pressure-sensitive operator for said position adjustable idler sprocket.

12. An apparatus as in claim 1 wherein said dogs are horizontally operating dogs.

13. An apparatus as in claim 1 wherein said dogs are vertically operating dogs.

14. A method of operating a chain-operated railway car indexer including the steps of:

(a) maintaining chain tension control by utilizing a device which operates directly on the chain;

(b) utilizing said chain tension control to control deployment of pair of car-engaging dogs by controlling the gap between a pair of consecutive, oppositely disposed dog carriages, each carrying an operable car-engaging dog, said car-engaging dogs being connected to one another by a common linkage which operates said car-engaging dogs in unison based on said gap such that when said gap is increased, said car-engaging dogs deploy and when said gap is decreased, said car-engaging dogs retract.

15. A method as in claim 14 including the step of enabling one of said pair of car-engaging dogs to be held in a deployed position or in a retracted position by external forces without affecting the normal operation of a remaining car-engaging dog.

* * * * *